United States Patent [19]

Wolfe et al.

[11] Patent Number: 5,045,659

[45] Date of Patent: Sep. 3, 1991

[54] DISPOSABLE MICROWAVE POPCORN CONTAINER

[75] Inventors: Robert E. Wolfe, Millis; John S. Sklenak, Sudbury, both of Mass.

[73] Assignee: Raytheon Company, Lexington, Mass.

[21] Appl. No.: 383,781

[22] Filed: Jul. 24, 1989

[51] Int. Cl.[5] ..... H05B 6/80; B65D 81/34

[52] U.S. Cl. ..... 219/10.55 E; 219/10.55 F; 219/10.55 M; 426/107; 426/115; 426/234; 426/243; 99/DIG. 14; 229/903; 229/DIG. 3

[58] Field of Search ..... 219/10.55 E, 10.55 F, 219/10.55 M; 426/107, 109, 110, 111, 113, 115, 234, 241, 243, 449; 99/DIG. 14, 323.5, 323.8; 229/114, 903, DIG. 3

[56] References Cited

U.S. PATENT DOCUMENTS

| | | | |
|---|---|---|---|
| 4,038,425 | 7/1977 | Brandberg et al. | 426/107 |
| 4,156,806 | 5/1979 | Teich et al. | 219/10.55 E |
| 4,158,760 | 6/1979 | Bowen et al. | 219/10.55 E |
| 4,190,757 | 2/1980 | Turpin et al. | 219/10.55 E |
| 4,279,933 | 7/1981 | Austin et al. | 426/234 |
| 4,453,665 | 6/1984 | Roccaforte et al. | 426/107 |
| 4,553,010 | 11/1985 | Bohrer et al. | 219/10.55 E |
| 4,586,649 | 5/1986 | Webinger | 426/111 |
| 4,777,053 | 10/1988 | Tobelmann et al. | 426/107 |
| 4,851,246 | 7/1989 | Maxwell et al. | 219/10.55 E |
| 4,873,406 | 10/1989 | Connor | 219/10.55 E |

*Primary Examiner*—Philip H. Leung

*Attorney, Agent, or Firm*—William R. Clark; Richard M. Sharkansky

[57] ABSTRACT

A disposable container for heating seeds, kernels, nuts, grains, popcorn or the like items, using microwave radiation. The container comprises a can-shaped package having a floor where the items are placed and held in a clump. As the items are heated with microwave radiation, the items pop, the cover panel and/or container walls expand to form a new shape wherein the walls are inclined toward the floor. As the items pop, the unpopped items continue to be directed into a clump. Alternatively, a ferrite and metal material may be placed on the floor to enhance the heating process.

15 Claims, 9 Drawing Sheets

DISPOSABLE MICROWAVE POPCORN CONTAINER

BACKGROUND OF THE INVENTION

The present invention relates to an improved package adapted to be used for packaging popcorn and more particularly to an expandable disposable package for popping popcorn in a microwave oven.

Popcorn has been heated in microwave ovens by coating the kernels with oil or butter and then enclosing the popcorn kernels within a paper or plastic bag. The microwave oven is turned on and the oil and kernels absorb microwave energy. The kernels then become hot and expand until they pop. A drawback to this method is that oil has been found to make the popped kernels greasy, less appealing and possibly pose a health risk. Further, it has been found that butter can become rancid after a period of time as might occur when the packages are stored on shelves for a lengthy period.

Another food package for cooking popcorn in a microwave oven is disclosed in U.S. Pat. No. 4,586,649. This package uses the technique known as "clumping" to concentrate the corn kernels in a small, compact area by having the configuration of the package be such that kernels be held together in an area or region of high heat concentration. As the kernels are heated, they will pop. When they pop, the heavier and smaller unpopped kernels will tend to fall back in to the area of greatest heat concentration during the popping process. This clumping technique is also described in U.S. Pat. No. 4,158,760. Using this method, an expandable bag of plastic film contains unpopped kernels and is located within a carton. The walls of the carton are shaped such that when the kernels pop, the unpopped kernels remain in a cluster or clump around the bottom of the carton. As the popcorn is heated, the top of the carton and the bag expands upward. One drawback of this package is that because of the shape of the package, the carton may take up significant shelf space on a store shelf. Further, this package, when used as a disposable carton, uses a plastic bag, which may interfere with the clumping process.

Another technique used for popping corn is placing the kernels in a container having a floor constructed from a microwave absorbing material, such as ferrite or waterglass coated over a thick metal sheet or ceramic. The microwave energy causes the floor to become hot and heat the kernels by conduction. Kernels contain a small amount of moisture which turns into steam when heated. When the kernels become hot, they expand or explode from the build up of pressure from the steam (internal temperature of explosion is approximately 420° F.). This method has a drawback in that ferrite material is not readily adaptable for disposable microwave packaging, as the ferrite becomes extremely hot and may burn paper it contacts. Another drawback is that the material used on the floor must be heated for a long period of time before it becomes warm. Further, the material used on the floor remains hot for a significant period of time after heating. Hence, the floor must be allowed to cool before it can be touched.

Heating popcorn in a disposable package in a microwave oven with the previously described techniques has the drawback that the popcorn can only be left in the oven for a short period of time once the first kernel pops. If the kernels are allowed to remain in the oven longer than that short time, the popped kernels will start to scorch and degrade. These techniques further require a long amount of time to pop all the kernels. Consequently, a large amount of kernels will not become popped.

SUMMARY OF THE INVENTION

An object of the present invention is to provide an improved popcorn package for use in a microwave oven.

Another object of the present invention is to provide an improved popcorn package which yields a high ratio of popped kernels to unpopped kernels.

Another object of the present invention is to provide a package which will expand, providing the volume of space needed for the popped corn and also allowing the unpopped kernels to clump while not requiring a significant amount of store shelf space.

Another object of the present invention is to provide a package which heats the kernels without having to provide an inner plastic bag which could interfere with the clumping process.

A further object of the present invention is to provide a popcorn heating package in a microwave oven which has a floor which heats up rapidly to heat kernels and cools down rapidly after being removed from the oven.

Also an object of the present invention is to provide a base for the heating package which becomes hot enough to pop kernels but does not burn the walls of a disposable package.

Another object of the present invention is to provide an apparatus which directs the kernels back into a clump while being heated while the walls of the carton expand outward.

It is also an object of this invention is to provide a package for popping kernels whereas the kernels do not have to be submerged in grease to aid the popping process.

An additional object of the present invention is the provision that the popcorn package may be easily manufactured and assembled with automatic machinery.

Another object of this invention is to provide a popcorn popper with a cover that is constructed to prevent air leakage during cooking.

These and other objects are accomplished with an apparatus for heating kernels, seeds, nuts, grains, and the like items comprising a container having a cup for retaining the items in a clump, and the container having a wall disposed adjacent the cup and wherein the wall expands outwards. The wall expands outward forming an inclined surface to direct said items displaced from the clump by the popping of other items back to the clump. By providing a package that expands in this manner, a significant amount of store shelf space is saved. Further, the walls continue to direct the items back into a clump while expanding outward, thereby concentrating the kernels and the heat given off by the kernels in a small region. This clumping technique allows the items to be heated without having to be coated with oil as a means of providing thermal conductivity. It may also be preferable that the container have an airtight cavity so that the walls are pushed outward due to the expansion of the air within the cavity.

Ultimately, a disposable package adapted for popping popcorn in a microwave oven is provided, the package comprises a lower region of reduced volume for holding unpopped kernels in a clump, thereby enabling microwave energy to heat the kernels to a popping temperature, a rim disposed along the upper portion of the lower region, and an upper region comprising a continuous vertical wall connected to the lower region and a cover, said wall having a plurality of vertical folds, thereby enabling the wall to be expandable from a storage configuration where the wall is substantially vertical from the rim of the lower region to a popped configuration where the wall fans upwardly and outwardly from the rim of the lower region so as to provide an inclined surface for directing unpopped kernels disturbed from the clump by the popping of other kernels back to the lower region by gravity, the wall being expandable from the storage configuration to the pop configuration by the popping of kernels within the package. It may also be preferable that the cover be integrally connected to the wall.

Another embodiment of an article for heating kernels in a microwave oven cavity is provided, the article comprising means for bunching kernels together in a clump within the cavity, covering means for directing kernels displaced from the clump back to the clump, and means disposed below the clump for absorbing microwave frequency energy and heating by conduction the kernels within the clump by both directing both kernels displaced back to the clump and heating kernels with a microwave absorbing means, the kernels will heat up rapidly and consequently, more kernels will pop before any other kernels start to degrade.

It may also be preferable that an apparatus be provided for popping kernels in a microwave frequency oven comprising base means for holding kernels and an integrated cover having a plurality of side walls or panels attached to the base means, wherein the side walls are in a substantially vertical position when the kernels are unpopped and wherein the side walls expand to a downwardly inclined position so as to direct unpopped kernels back into said base when the kernels pop to force the kernels into a confined volume which will allow the kernels to pop in a microwave field. It may also be preferable that the integrated cover comprise a cover panel integrally connected to the side walls and substantially covers the kernels, wherein the level of the center of the cover panel rises upwards after the side walls expand. By using an integrated cover stamped from a single sheet with the side walls integrally connecting to the cover, the integrated cover can be easily manufactured without having to glue many separate pieces together.

A further embodiment of the package for popping kernels in a microwave frequency oven is provided, the package comprising a metal sheet supporting unpopped kernels, a binder material containing a multiplicity of microwave absorbing particles coated over the sheet resulting in heat being conducted to the kernels when the particles are placed in a microwave field. This heat causes the kernels to pop. A cover means is attached to the sheet for confining the popped kernels to a region above the sheet and means for attaching the cover means to the sheet is provided so that when the microwave absorbing particles become hot, the cover is prevented from scorching. By using a metal sheet coated with a binder material containing microwave absorbing particles to support the unpopped kernels, the heating package will become hot enough when exposed to a microwave field to pop kernels. An area is provided between the coated metal sheet and the location where the cover attaches to the metal sheet to allow heat to dissipate from the absorbing particles to prevent the walls of the disposable package from burning. Further, by using a thin metal sheet coated with binder material, the supporting sheet will cool down relatively quickly after the package is removed from the microwave oven.

It may also be preferable that the invention be practiced by the method of popping kernels comprising the steps of placing a container having substantially vertical walls within a microwave oven cavity, placing kernels within the container, heating the kernels with microwave energy so that kernels pop, bunching the unpopped kernels displaced from the cluster, when said kernels are being heated, back into the cluster, and expanding the container walls when the kernels are displaced from the cluster so as to direct said unpopped kernels back into said cluster by gravity. It may further be preferable that the container walls expand outward from said cluster when the kernels are displaced from the cluster.

BRIEF DESCRIPTION OF THE DRAWINGS

The above and other advantages of this invention will become apparent from the following description, taken in connection with the accompanying drawings, wherein.

DESCRIPTION OF THE PREFERRED EMBODIMENT

Figure 1:
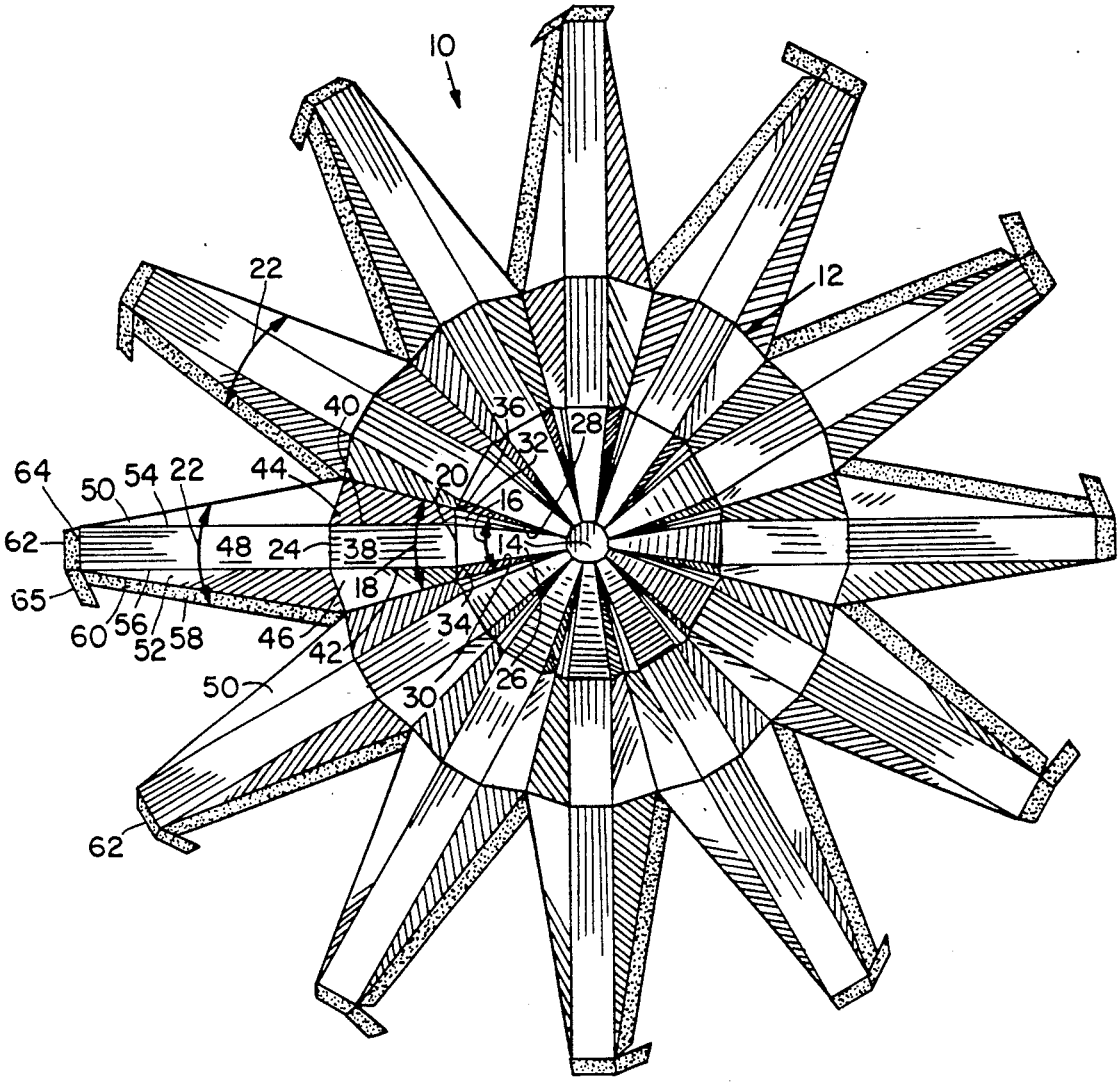
FIG. 1 is a plan view of a blank which may be used for making the walls and ceiling of the integrated cover of the present invention.

Referring to FIG. 1, there is shown a blank of the integrated cover 10 used in the making of a popcorn container of the present invention comprising a cover panel 12 having circular center panel 14. Along the perimeter of the circular center panel 14 extends a plurality of twelve identically shaped inner closure panels 16 shaped in the form of a quadrangle. Along the opposite side of each inner closure panel 16 from circular center panel 14 is an outer closure panel 18 that is foldable relative to inner closure panel 16 along fold line 20. Along the opposite side of each outer closure panel 18 from inner closure panel 16 is a side panel 22 that is foldable relative to outer closure panel 18 along fold line 24. Examplary inner closure panel 16, outer closure panel 18, and side panel 22 will be explained.

Disposed in the center of inner closure panel 16 is inner center panel 26 shaped in the form of a quadrangle. Along opposite sides of center panel 26 adjacent fold line 28 and fold line 30 are inner ceiling panel 32 and inner ceiling panel 34, respectively. Both fold line 28 and fold line 30 are disposed on the other side of integrated cover 10. Adjacent inner ceiling panel 32 on the opposite side of fold line 28 is fold line 36 which folds this side of integrated cover 10.

Disposed in the center of outer closure panel 18 is outer center panel 38 shaped in the form of a rectangle. Along opposite sides of outer center panel 38 adjacent fold line 40 and fold line 42 are outer ceiling panel 44 and outer ceiling panel 46, respectively. Both fold line 40 and fold line 42 are disposed on the other side of integrated cover 10. Adjacent outer center panel 38 on the opposite side of fold line 20 is fold line 24 which folds this side of integrated cover 10.

Extending through the center of side panel 22 is side wall 48 shaped in the form of a rectangle. Side wall 48 extends from the fold line 24 along outer center panel 38. Extending on opposing side edges of side wall 48 within side panel 22 is flap 50 and flap 52 which fold this side of integrated cover 10 along fold line 54 and fold line 56. Disposed within side panel 22 along the opposite edge of flap 52 from side wall 48 is glue flap 58. Glue flap 58 has glue along its top surface which engages with the bottom surface of flap 50 of the adjacent side panel 22. Glue flap 58 folds along the fold line 60 which is disposed on the other side of integrated cover 10.

Disposed on the opposite end of side panel 22 from outer closure panel 18 is tab 62. Tab 62 folds downward along fold line 64. Integrally connected to tab 62 is extending tabs 65 which engage with the bottom surface of tab 62 on adjacent side panel 22. Tab 62 contains glue on its top surface which engages with cup or cone 66 (FIG. 4) on its rim 122. The details of this cone 66 will be explained later in more detail in connection with FIGS. 5–7.

The integrated cover 10 is preferably made out of paper, but other materials may be used such as plastic or cellophane, so long as the material does not melt or break when exposed to microwave energy and hot popcorn kernels. The paper may also be laminated or treated with a food safe, fire-retardant chemical.

Figure 2:
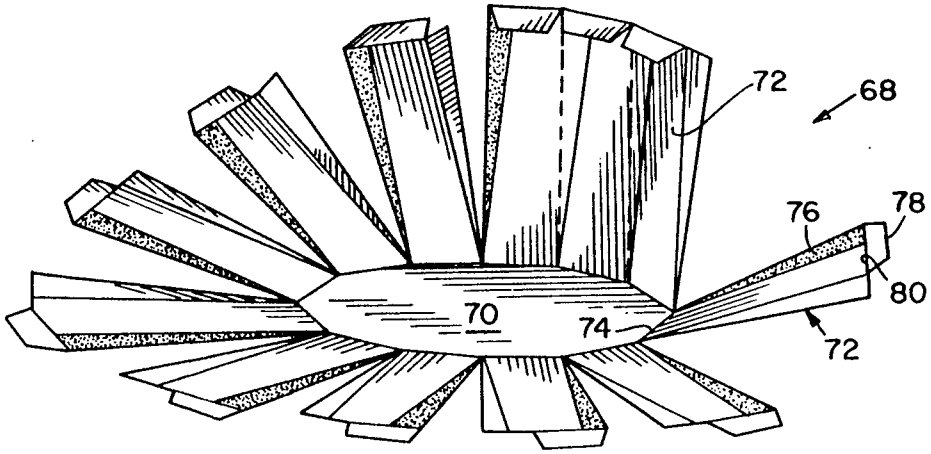
FIG. 2 is a side view of a blank which may be used for making the base of the present invention.
Figure 6:
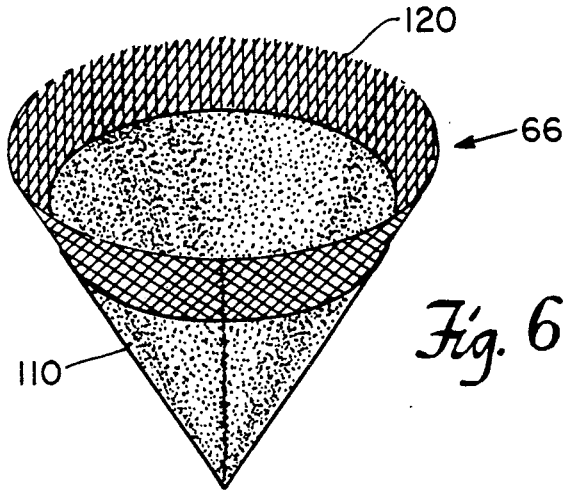
FIG. 6 is a perspective view of the assembled cone make from the microwave absorbing material.

Referring to FIG. 2, there is shown a blank for the base 68 of the popcorn container for supporting cone 66 shown in FIG. 6 made from a microwave absorbing material. Base has a circular shaped floor 70 having a plurality of twelve identically shaped rectangular wall sections 72 extending outwardly along the perimeter of the floor 70. Circular shaped floor preferably has a 3 inch diameter. Exemplary wall section 72 folds upward along perimeter fold line 74. Wall section 72 has an inner surface 76 upon which glue is applied so that when wall section 72 is folded upward, wall section 72 engages with the adjacent wall section 72.

At the opposite end of wall section 72 from floor 70 is tab 78 which folds downward along fold line 80. Tab 78 attaches to cone 66 (see FIG. 4).

Figure 3:
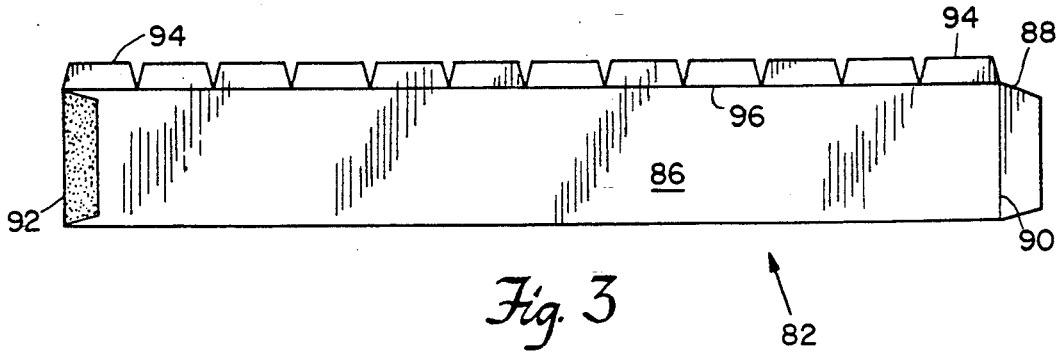
FIG. 3 is a plan view of a blank which may be used for making the base without a floor of the present invention.
Figure 6A:
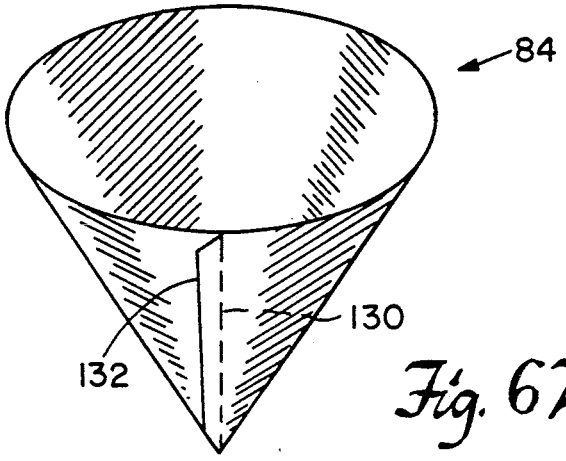
FIG. 6A shows a perspective view of the assembled cone made from paper.

Referring to FIG. 3, there is shown a blank of a base 82 for the popcorn carton for use with a cone 84 shown in FIG. 6A made from paper. Base 82 has a rectangular wall section 86 having a tab 88 at one end. Tab 88 folds along fold line 90. On the opposite end of wall section 86 from tab 88 is glue area 92. Tab 88 contacts glue area 92 when base 82 is assembled to form a cylindrical shape. Along the top edge of rectangular wall section 86 are identically shaped tabs 94 which fold inwardly along fold line 96. Glue is applied to the outer surface of tabs 94. A paper cone (FIG. 6A) is mounted within base 82. Tabs 94 attach to paper cone 84 (see FIG. 12) along its top edge or rim.

Figure 4:
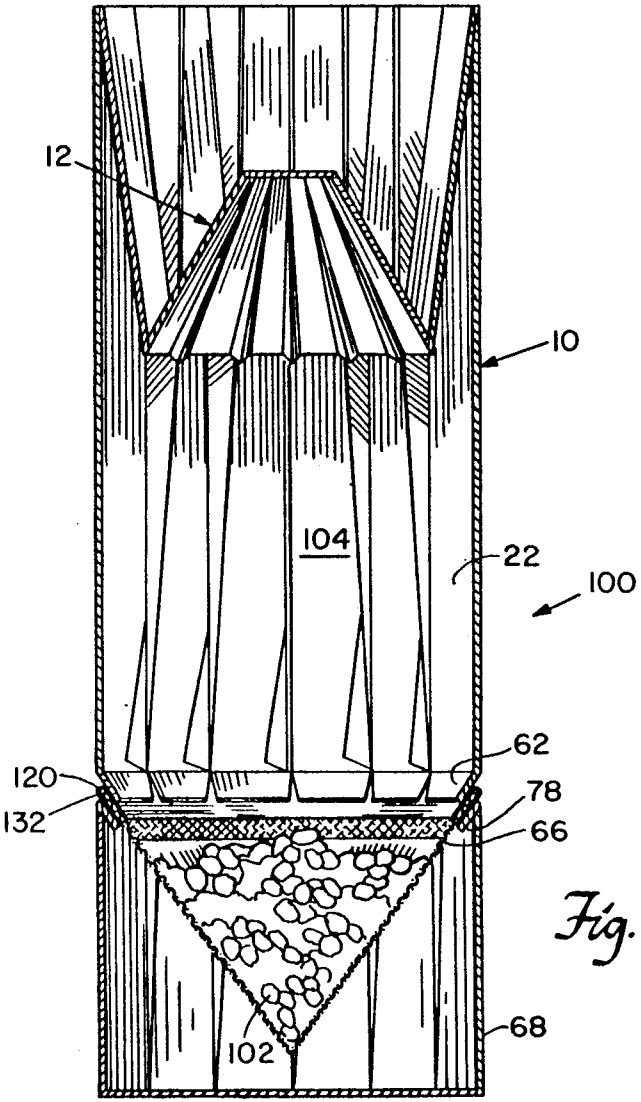
FIG. 4 is a side sectioned view showing the finished carton in its storage configuration.

Referring to FIG. 4, there is shown a preferred embodiment of a microwave popcorn container 100 in the storage configuration containing unpopped kernels 102. The container 100 has a base 68 supporting a cone 66 made from a microwave absorbing material. The integrated cover 10 is folded to mount on cone 66. Further details of this attachment between the integrated cover 10 and the cone 66 will be explained later. When folded, the integrated cover 10 forms a cavity 104 with cone 66.

Mounted in base 68 is cone 66 which holds unpopped kernels 102. Cone 66 is preferably made out of a metal mesh coated with a silicone or equivalent binder containing a lossy microwave absorbing material such as ferrite, details of which will be explained later. Alternately, a cone 84 shown in FIG. 6A may be substituted for cone 66. Cone 84 may be made out of paper or another laminated material which is strong enough to hold the unpopped kernels 102 and will not burn from the adjacent foodstuff when heated in a microwave oven.

If cone 84 is constructed out of paper, it is preferable that the base 82 in FIG. 3 be used and that the cone 84 be sealed air tight. If the cone 66 that is constructed from a microwave absorbing material is used, it is recommended that the base 68 shown in FIG. 2 be used and is air sealed so that hot air will not leak out of the inside the popcorn container. This leakage may prevent the integrated cover 10 from expanding during operation.

Figure 5:
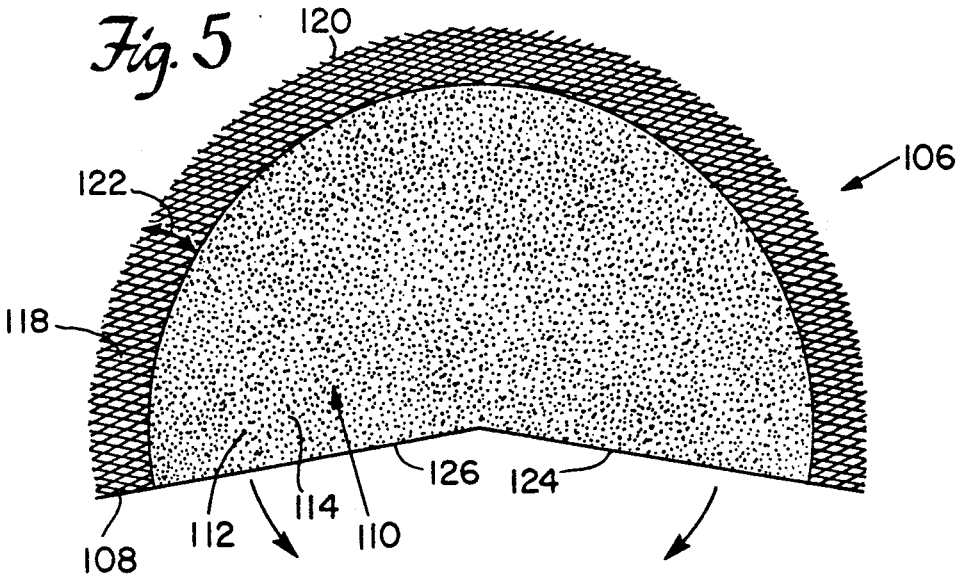
FIG. 5 is a plan view of the microwave absorbing cone before assembled.

Referring to FIG. 5, there is shown a preferred embodiment of an unassembled microwave absorbing cone 106 constructed from a mesh 108 coated with a microwave absorbing material 110. The mesh used has a radius of 2.625 inches. The mesh strands 107 preferably have a thickness of 0.010 inches. The distances between the intersections of the strands 107 across perforations 118 is 0.077 inches by 0.038 inches. The total weight of the microwave absorbing material on the cone 66 is between 7.7 to 9.5 grams. The aluminum mesh 108 is preferably coated on its top and bottom surface with the microwave absorbing material 110. The microwave absorbing material 110 includes a heat resistant binder material 112 and a plurality of microwave absorbing particles 114, such as ferrite ($Fe_3O_4$), contained within the binder material 112. Preferred binders include DC 595 silicone, sold by DOW Corporation of Midland, Mich. and GE SLE 5600 Silicone sold by General Electric Corporation of Schenectady, N.Y. It is preferable that the binder be mixed with $Fe_3O_4$ such that the proportions are preferably bu weight one part $Fe_3O_4$ to three parts binder. Further, the microwave absorbing materials described in U.S. Pat. No. 4,190,757 may be used and are hereby incorporated by reference. The preferred embodiment shows a mesh 108 made from metal coated with a microwave absorbing material 110; however, other microwave absorbing structures may be used such as an aluminum sheet coated with a microwave absorbing material. A coated metal mesh is preferred because microwave energy heats the kernels and further, the microwave absorbing material becomes hot and heats the kernels by conduction.

The microwave absorbing material 110 contains binder 112 and microwave absorbing material 114 that are preferably attached to the mesh 108 by spraying; however, the binder 112 may be bound to mesh 108 by rolling or any other equivalent method. It is preferable that the microwave absorbing material 110 be applied to both sides of the mesh 108 and that the microwave absorbing material 110 is disposed in the perforations 118 within the mesh 108. It is also preferable that the microwave absorbing material 110 be applied to a portion of mesh 108 and not applied to a rim or region 122 within ¾ inch from the outside edge 120 of the cone 66. By not applying absorbing in region 122, the metal mesh 108 can act as a heat sink between the microwave absorbing material 110 and the integrated cover 10. It is recognized that by having a heat sink region 122 during the heating of the kernels, the integrated cover 10 is less likely to burn, as the microwave absorbing material 110 does not contact the integrated cover 10. Further, heat from the microwave absorbing material 110 is dissipated in the insulation region 122.

Referring to FIG. 6, there is shown an assembled cone 66 made with of a microwave absorbing material 110 shown in FIG. 5. Microwave absorbing cone 106 is bent so that edge 124 (FIG. 5) engages edge 126 (FIG. 5) to form a cone 66. The microwave absorbing material 110 is disposed over the mesh 108 on the lower part of the cone 66. No microwave absorbing material 110 is applied to the mesh 108 in region 122.

Referring to FIG. 6A, there is shown an assembled cone 84 made from paper. The cone 84 is shaped like cone 66 shown in FIG. 6. Cone 84 is shaped so that edges 130 engage glue tab 132. Edge 132 is held in place with glue.

Figure 7:
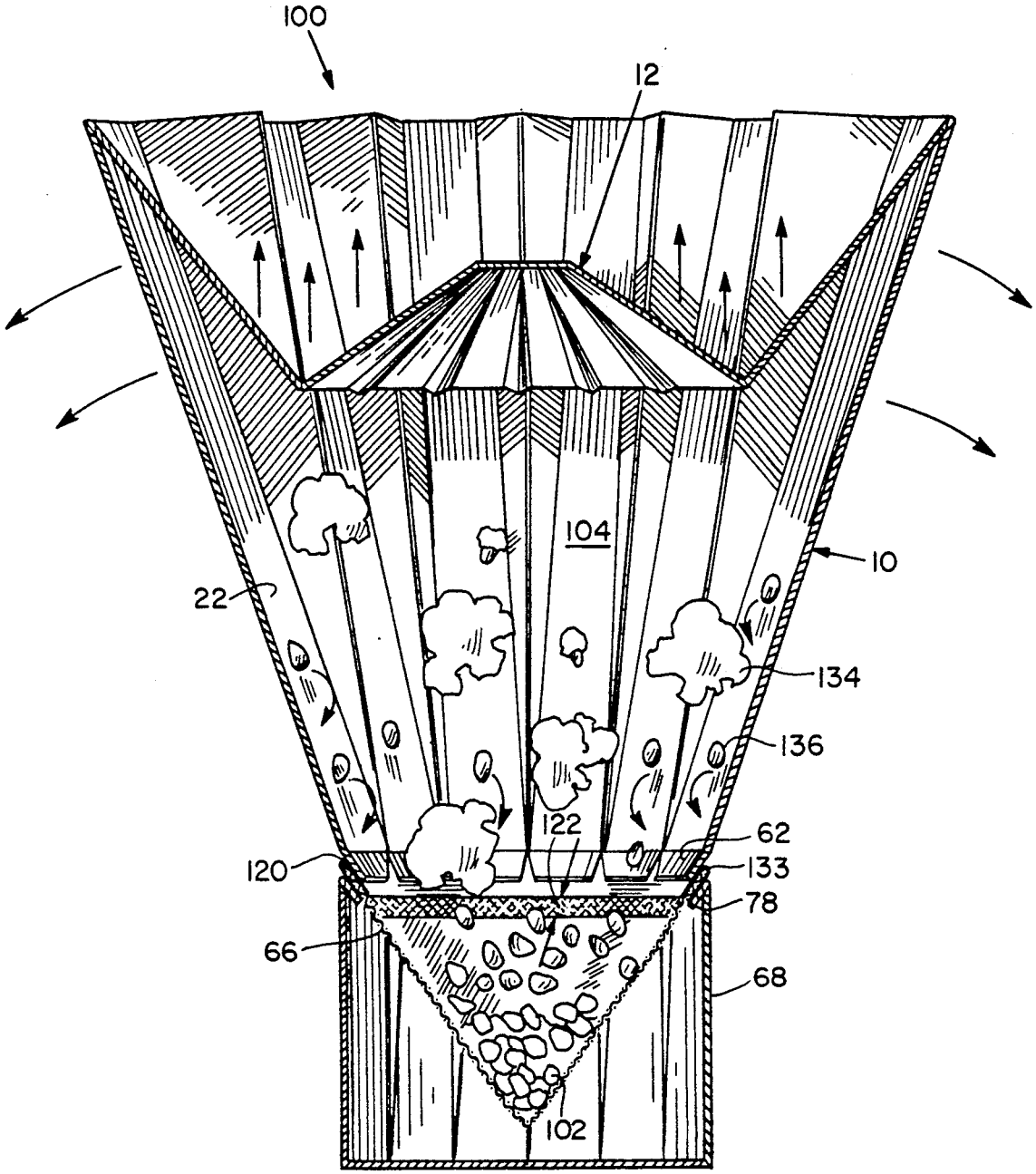
FIG. 7 is a side sectioned view showing a preferred embodiment of the microwave package as it is being cooked in a microwave oven.

Referring to FIG. 7, there is shown the microwave popcorn container 100 having a base 68 holding cone 66 and supporting the integrated cover 10. The cone 66 holds unpopped kernels 102 in a clump. The unpopped kernels 102 are clumped together and remain in a small region. As is well known, individual kernels do not typically retain enough heat when heated in a microwave field to pop. However, when the unpopped kernels 102 are clumped together in a microwave field, kernels become hot and release heat on its surface. As kernels contact each other, the heat from one kernel will heat its adjacent kernels. Further, heat released from the surfaces of all the kernels in the clump will remain concentrated in a small region. This heat concentration causes the kernels 102 to become hot and expand. This method of heating kernels is explained in more detail in U.S. Pat. No. 4,158,760, which is hereby incorporated by reference. The cone 66, because it contains microwave absorbing material, becomes hot in the presence of microwave energy. This heat also heats the kernels.

In addition, microwaves heat the water within the kernels. When the kernels reach approximately 420° F., the kernels expand, releasing steam into cavity 104. Further, the microwave energy heats the kernels. These kernels become hot and give off heat to the surrounding air in cavity 104. The air in cavity 104 then expands. As the popcorn container 100 is totally sealed, the side panels 22 expands outward and the cover panel 12 rises.

Referring to FIGS. 4 and 7, the microwave absorbing cone 66 is connected to the integrated cover 10 and base 68 of microwave popcorn container 100. Cone 66 is shown having microwave absorbing material 110 disposed over mesh 108 on the lower section of the cone 66 and no microwave absorbing material 110 over the mesh 108 along spacing on the upper section of the cone 66. Tabs 78 on the base attach to the bottom surface of cone 66 in the insulation region 122. Tabs 62 on integrated cover 10 attach to the top surface of cone 66 in the insulation region 122. Insulation region 122 is wide enough to allow heat from the microwave absorbing material 110 on cone 66 to dissipate so that the points where the tabs 62 on the integrated cover 10 and the points where tabs 78 on the base 68 contact the cone 66 will not become too hot and burn. Alternately, the tabs may be attached to the cone 66 with a heat insulation material 133 or binder material 112 to prevent burning of the paper. It is also preferable that the integrated cover 10 is prevented from directly contacting the edges of the cone 66. It has been recognized that these edges 120 become very hot during heating and could cause paper contacting edge 120 to burn. The tabs 78 on base 68 and tabs 62 on integrated cover 10 are preferably connected to the cone 66 with a glue or binder material able to sustain high temperatures (upwards of 500° F.) without losing its adherence.

Referring to FIG. 7, as the kernels expand, they explode, resulting in popped 134 and unpopped kernels 136 flying upward. The side panel 22 of the integrated cover 10 expands outward as the kernels rise and the air in the cavity 104 becomes hot. The unpopped kernels 136 will fall back into the cone 66 by sliding down the side panel 22 of the integrated cover 10 and then being directed back into a clump within the cone 66. Simultaneously, as the side panel 22 of the integrated cover 10 expand outward, cover panel 12 rises to make room for more popped kernels. It is recognized that the side panels 22 of the microwave popcorn container 100 continue to direct unpopped kernels 136 back into the cone 66 during the popcorn heating process.

Referring to FIG. 4, when the disposable microwave popcorn container 100 is stored, the side panel 22 of the integrated cover 10 are substantially vertical.

Referring to FIG. 7, as the kernels 102 continue to pop and the air in cavity 104 becomes hot and expands. As cavity 104 is sealed, the hot air pushes the side panel 22 outward to an angle that causes the unpopped kernels 136 to fall downward into cone 66. This final angle of side panel 22 is preferably 35° from vertical to match that of the cone. It is recognized that by using a microwave absorbing cone 66 which clumps the kernels 102 in addition to becoming hot by absorbing microwave energy, a high percentage of unpopped kernels will pop before any previously popped kernels begin to degrade.

Figure 8:
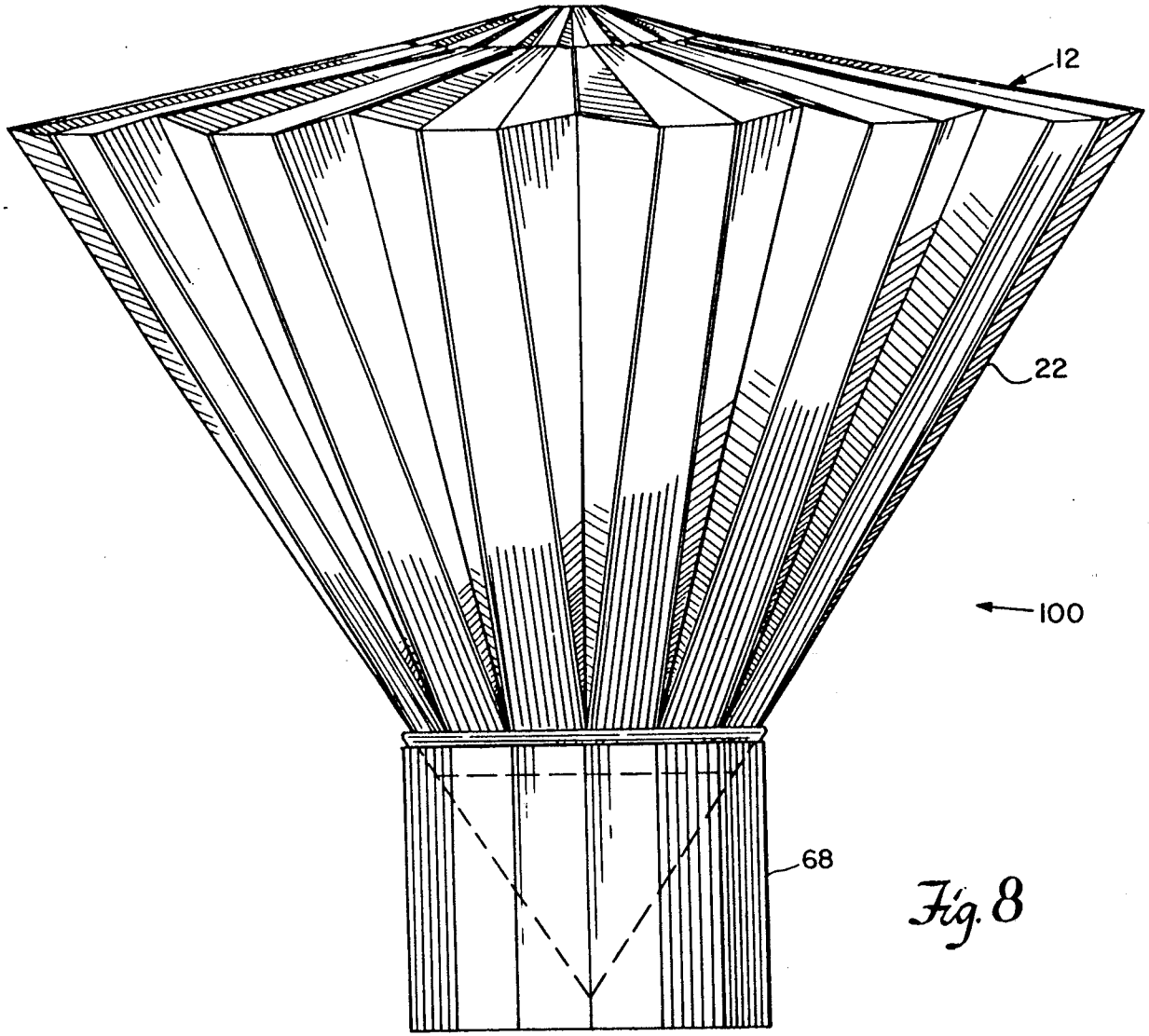
FIG. 8 is a side sectioned view showing the microwave package fully expanded after the kernels have popped.

Referring to FIG. 8, there is shown the disposable microwave popcorn container 100 in its fully expanded configuration after all the kernels have popped. It is recognized that the cover panel 12 of the integrated cover 10 expands and rises upward to make room for popped kernels without interfering with the clumping process. It is also recognized that side panels 22 expand outward to a 70° inclusive angle.

Figure 9:
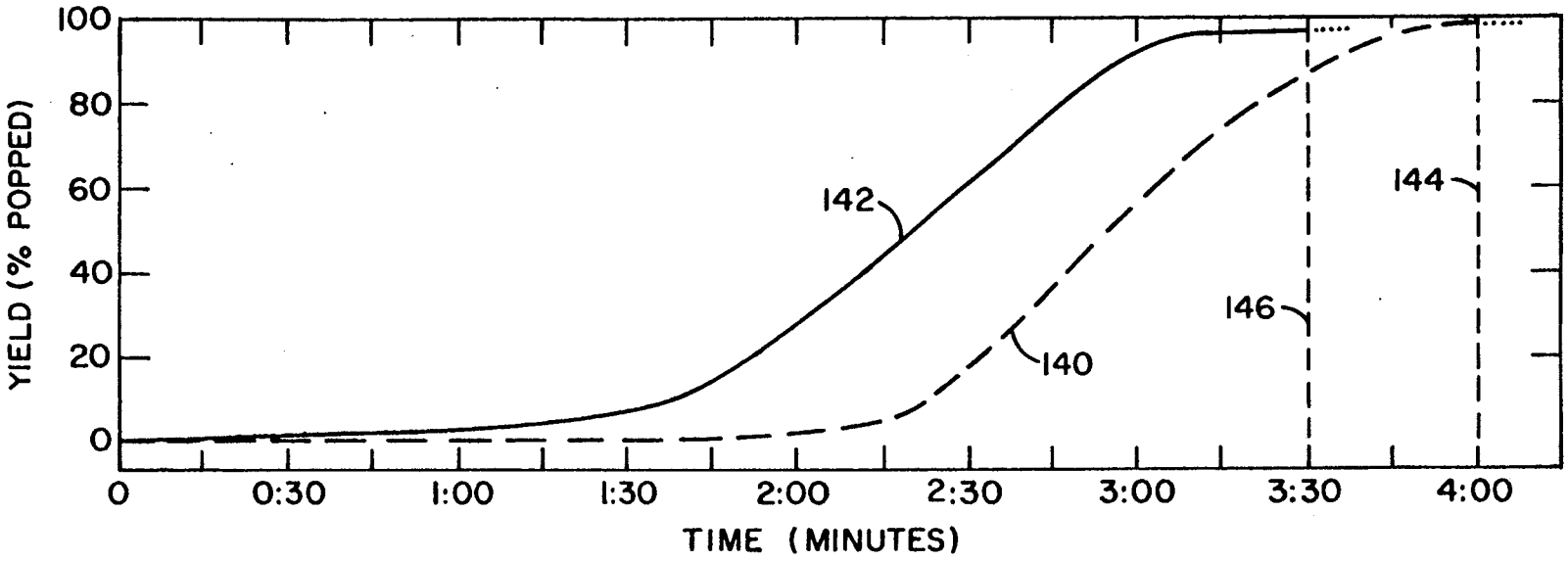
FIG. 9 is a plot of the percentage of popped kernels using a base made from mesh coated with microwave absorbing material and a base made from paper.

Referring to FIG. 9, there is shown a graph of the percentage of popped kernels versus time for the kernels to pop using the disposable microwave popcorn container 100 shown in FIG. 4 using cone 66 containing microwave absorbing material shown in FIG. 6 (Line 140) and a cone 84 constructed totally out of paper or paperboard (Line 142). The cone 66 constructed out of a microwave absorbing material containing a mesh. The dimensions used are described in FIG. 5. The binder material used was GE 5600 Silicone. The kernels were heated in a 675W Amana microwave oven using an initial 80 grams of kernels. The yield percentage of popped kernels is listed by weight.

Line 140 shows the percentage of popped kernels versus the time using cone 66, recognizing that the percentage of popped kernels becomes upwards of 98% before the popped kernels begin to degrade (Line 144). It is also recognized that the time period between the first kernel popping and the last kernel popping before any popped kernels begin to degrade is greater than two minutes.

Line 142 shows the percentage of popped kernels versus time using microwave popcorn container with a cone 84 made from paper or paperboard. Line 146 indicates the point in time when the popped kernels start to degrade. It is recognized that when using a cone 84 made from paper, a substantial percentage (upwards of 96%) of kernels are popped, but not to the extent that the cone 66 constructed out of microwave absorbing material pops the kernels but finishes popping them about 45 seconds sooner. It is also recognized that the time period between the first kernel popping and the time the popcorn begins to degrade is also greater than two minutes.

Figure 10:
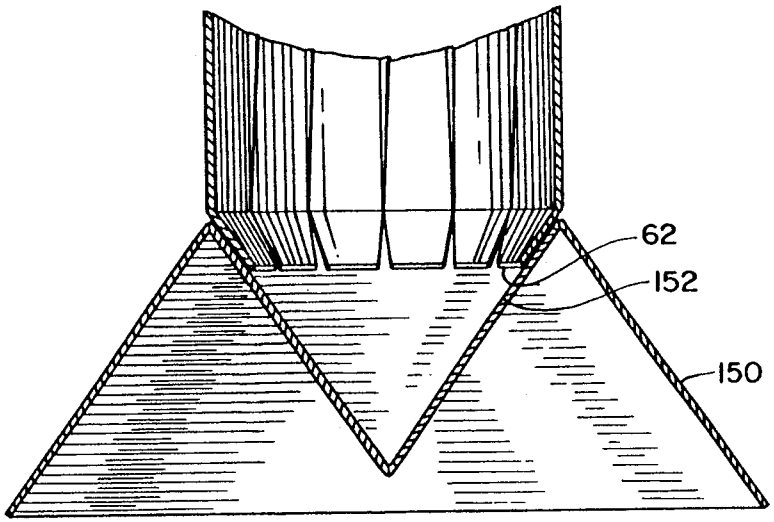
FIG. 10 is a side sectioned view of an alternate embodiment of a paper base using a wider support.

Referring to FIG. 10, there is shown an alternate embodiment of the microwave container 100 having a wider base 150 constructed from paper or paperboard to provide more support for the integrated cover 10. In this configuration, the wide base 150 and cone are an integral unit and are directly attached to the integrated cover's tabs 62 are attached to wide base with glue 152.

Figure 11:
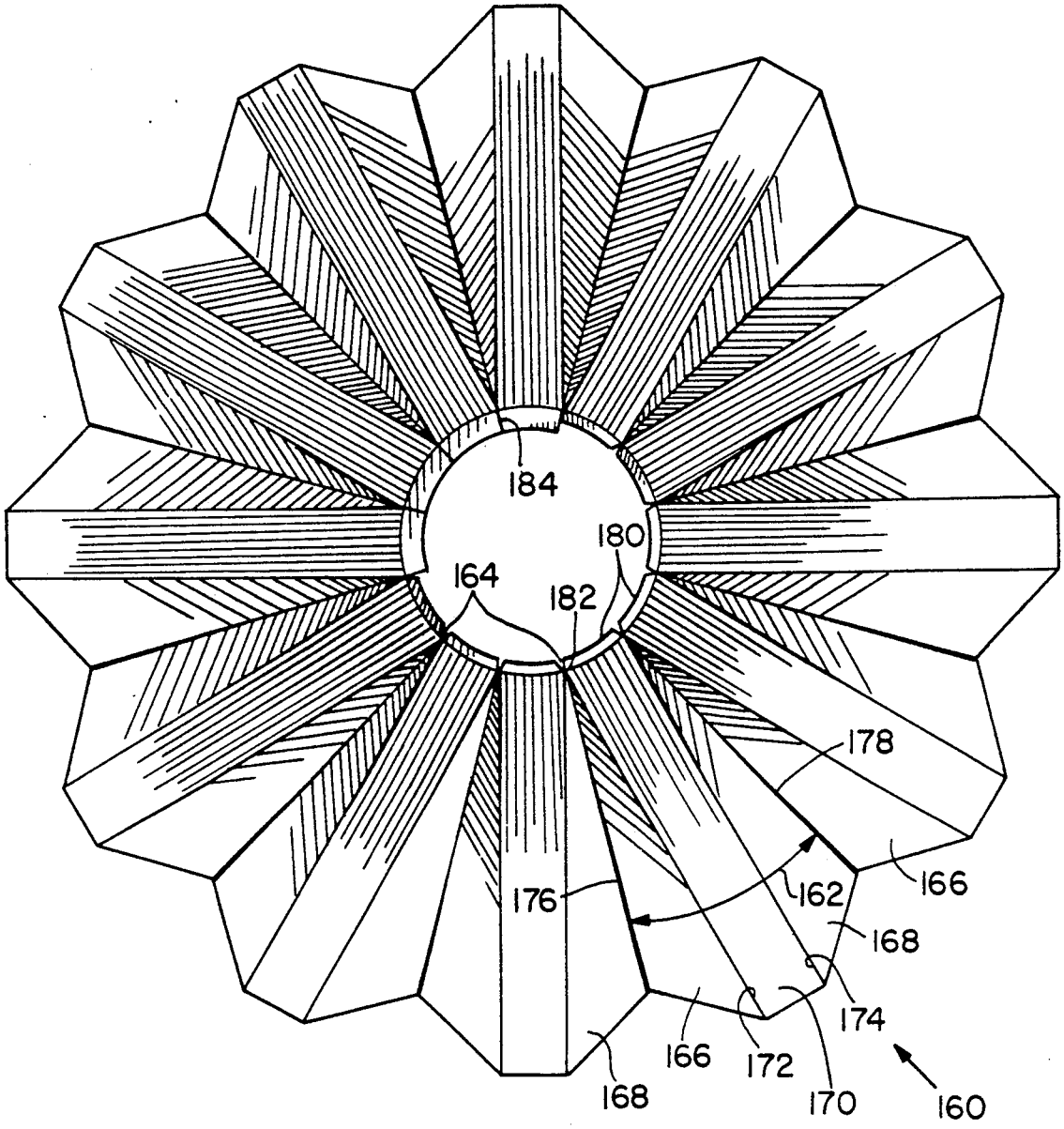
FIG. 11 is a plan view of an alternate embodiment of a blank which may be used for making side panels for the microwave package.

Referring to FIG. 11, there is shown an alternate embodiment of the blank for cover 160. This cover 160 contains a plurality of twelve identically shaped side panels 162 extending outwardly from an inner cut-out circle 164. These side panels 162 contain flap 166 and flap 168 separated by rectangular center panel 170. Flap 166 and flap 168 fold on opposing sides of center panel 170 along fold line 172 and fold line 174. These fold lines 172 and 174 fold from the other side of the cover 160. On the opposite sides of flap 166 and flap 168 from center panel 170 is flap 168 and flap 166 which folds this side of cover 160 along fold line 176 and fold line 178. The perimeter of cover 160 is shaped in a circle. When cover 160 is properly folded, the side panels 162 expand during popcorn heating. On the inner edge of each side panel is optional tab 180. Tab 180 is formed by cutting along line 182 and line 184. Within cut out circle 164 are a plurality of tabs 180.

Figure 12:
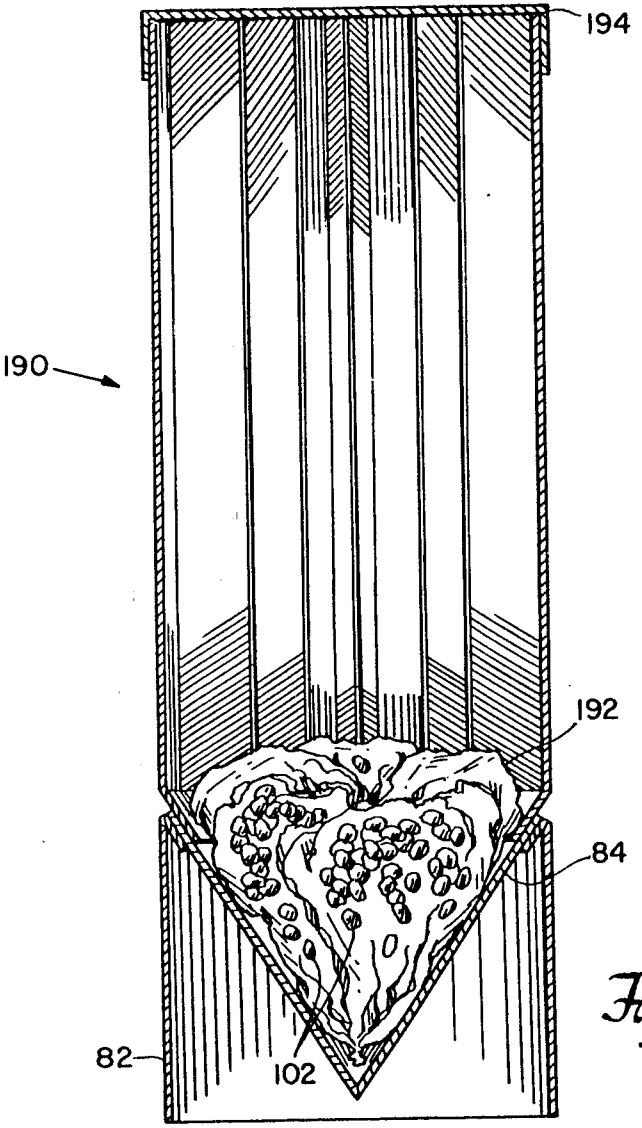
FIG. 12 is a side sectioned view of an alternate embodiment of the package shown in FIG. 6 using a paper base shown in FIG. 3 and a side panel shown in FIG. 11.

Referring to FIG. 12, there is shown an alternate embodiment of the disposable microwave popcorn container 190 using the cover 160 shown in FIG. 11. This microwave popcorn container 190 contains a base 82 supporting a preferable cone 84. Cover 160 is engaged with base 82 by gluing tabs 180 to cone 84. If tabs 180 are not used, base 82 engages directly with cone 84. Kernels 102 are contained within microwave popcorn container 190 in a plastic bag 192. Plastic cover 192 is glued to the top edge of cover 160.

The shape of the blank for cone 84 is shown in FIG. 5. Cone 84 is constructed by gluing edge 130 to glued tab 132 to form cone 84 shown in FIG. 6A.

It is preferable that the cone 84 be made from a paper or equivalent material to avoid burning of the plastic bag 192 during popcorn heating.

Microwave popcorn container 190 has a removable cover 194 which holds the side panels 162 in place during storage and transportation. The cover 194 is removed prior to microwave heating.

Figure 13:
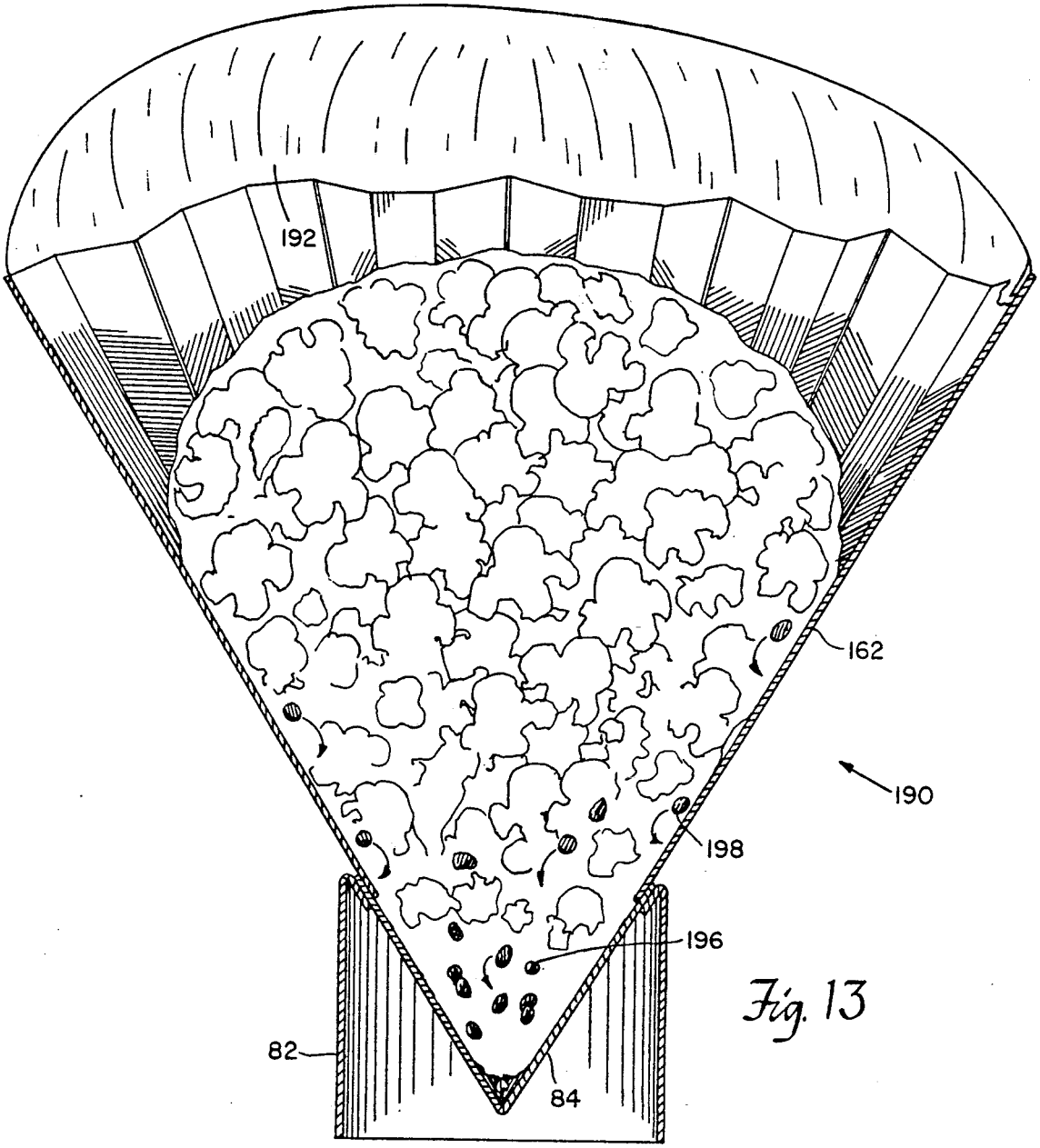
FIG. 13 is a side sectioned view showing the microwave package of FIG. 12 while the kernels are expanding.

Referring to FIG. 13, there is shown the microwave popcorn container 190 in which kernels 196 have started to expand during the microwave heating process. The kernels 196 are disposed in the plastic bag 192 located within the cone 84. As the kernels 196 expand, the kernels 198 explode upwards and the air in bag 192 becomes hot and bag 192 expands. The side panels 162 of the microwave popcorn container 190 then expands outward. As the kernels continue to pop, the unpopped kernels 198 slide down side panel 162, fall back into the cone 84, where kernels 196 are clumped together, become heated, and continue to pop. The side panels 162 will expand outward during heating to a preferable 70° inclusive angle, thereby continuing to direct the unpopped kernels 198 back into the cone 84 within base 82 of the microwave popcorn container 190.

This concludes the description of the preferred embodiment. A reading of those skilled in the art will bring to mind many modifications and alternatives without departing from the spirit and scope of the invention. Accordingly, it is intended that the invention only be limited by the following claims.

What is claimed is:

1. A disposable package adapted for popping popcorn kernels in a microwave oven, said package comprising:

a lower region for holding unpopped kernels in a clump and having a rim disposed along an upper portion of said lower region; and an upper region comprising a continuous wall connected to said rim and a cover connected to said continuous wall, said wall having a plurality of substantially vertical folds, and being expandable from a storage configuration where said wall is substantially vertical to a popped configuration where said wall is inclined to direct unpopped kernels disturbed from the lower region back to the lower region.

2. The package as recited in claim 1, wherein said cover is integrally connected to said wall.

3. An article for heating kernels in an oven cavity having microwave frequency energy radiated therein, said article comprising:

means for bunching kernels together in a clump within said cavity;

continuous means, expandable in response to the heating of the kernels from a substantially vertical position to an inclined position, for directing kernels displaced from said clump back to said clump; and means disposed below said clump for absorbing microwave frequency energy and heating by conduction said kernels within said clump.

4. The article recited in claim 3 comprising means for attaching said absorbing means to said continuous means.

5. An article for heating popcorn kernels in a microwave oven cavity having means for transmitting microwave frequency radiation into said cavity, said article comprising:

means for heating said kernels by conduction when said microwave frequency radiation is transmitted; and a container disposed within said cavity and holding said kernels, said container having an internal first and second region, wherein the first region is disposed in a substantially vertical position and above the second region and is expandable to an inclined position in response to the heating of the popcorn kernels.

6. The article as recited in said heating means comprises a microwave conductive material and a microwave absorbing lossy material.

7. The method of popping kernels in a microwave oven cavity comprising the steps of:

placing a container having continuous substantially vertical walls within said microwave oven cavity;

placing kernels within said container in a cluster;

heating said kernels with microwave energy so that the kernels pop;

bunching said unpopped kernels displaced from said cluster, when said kernels are heated, back into said cluster; and expanding said container walls to an inclined position to direct said unpopped kernels displaced from said cluster back into said cluster by gravity.

8. The method of popping kernels as recited in claim 7 wherein said container walls expand outward from said cluster when said kernels are displaced from said cluster.

9. The method as recited in claim 7 further comprising the step of heating said bunched kernels by conduction while said kernels in said cluster are being heated with microwave frequency radiation.

10. An apparatus for popping kernels in a microwave frequency oven comprising:

base means for holding kernels; and an integrated cover having a plurality of side walls attached to said base means, wherein said side walls are in a substantially vertical position when said kernels are unpopped and wherein said side walls expand to a downwardly inclined position so as to direct unpopped kernels back into said base when said kernels pop.

11. The apparatus as recited in claim 14 wherein said integrated cover comprises a cover panel integrally connected to said side walls and substantially covers said kernels, wherein the level of the center of said cover panel rises upward as said side walls expand.

12. The apparatus as recited in claim 11 wherein said base means comprises:

means for supporting said cover; and cup means for holding said kernels in a clump.

13. A package for popping kernels in a microwave frequency oven comprising:

a metal sheet supporting unpopped kernels;

a binder material containing a multiplicity of microwave absorbing particles coated over said sheet to heat said kernels, thereby causing said kernels to pop;

cover means attached to said sheet for confining said popped kernels to a region above said sheet; and means for attaching said cover means to said sheet so that when said microwave absorbing particles become hot, said cover is prevented from scorching.

14. The package as recited in claim 13 wherein said sheet comprises a plurality of perforations.

15. The package as recited in claim 13 wherein said cover is constructed from paper.

* * * * *